United States Patent [19]

Krafft

[11] 4,118,854

[45] Oct. 10, 1978

[54] POWDER ROOM AND BATHROOM SYSTEM AND METHOD OF ASSEMBLING SAME

[75] Inventor: Kurt Krafft, Prospect, Ky.

[73] Assignee: Systems Design & Development, Prospect, Ky.

[21] Appl. No.: 719,270

[22] Filed: Aug. 31, 1976

Related U.S. Application Data

[62] Division of Ser. No. 514,807, Oct. 15, 1974, Pat. No. 3,978,529.

[51] Int. Cl.[2] ..... A47K 4/00

[52] U.S. Cl. ..... 29/428

[58] Field of Search ..... 29/428, 469; 52/34, 52/35; 4/3-6, 2, 211, 192

[56] References Cited

U.S. PATENT DOCUMENTS

| | | | |
|---|---|---|---|
| 2,653,357 | 9/1953 | Sanders et al. | 4/2 |
| 3,110,907 | 11/1963 | King | 4/2 |
| 3,221,454 | 12/1965 | Togni | 4/192 X |
| 3,230,549 | 1/1966 | McMurtrie et al. | 4/2 |
| 3,381,313 | 5/1968 | Rothmayr | 4/2 |
| 3,590,392 | 7/1971 | Hollander et al. | 4/2 |
| 3,590,393 | 7/1971 | Hollander et al. | 4/2 |
| 3,611,451 | 10/1971 | Armstrong | 4/2 |
| 3,620,246 | 11/1971 | Shoquist | 52/34 |
| 3,694,973 | 10/1972 | Unger | 52/34 |
| 3,774,631 | 11/1973 | Wilkins | 4/211 X |

*Primary Examiner*—MIlton S. Mehr
*Attorney, Agent, or Firm*—Pennie & Edmonds

[57] ABSTRACT

A combination of pre-dimensioned and pre-engineered modular units which form at least a powder room within a room section of a building structure and a method of assembling same. The assemblage includes a interface unit having a drain-waste-vent piping system for the room, the unit being mounted to the surface of the "wet wall" of the room. The walls of the room may be either partially finished or completely finished at the time of assembly of the facility. The interface it provides a unique template for locating the positions of, and for installing the components of the facility. By extending the powder room assemblage to include a bathtub and shower section, a unique full bathroom may be assembled in a very short time according to the method of the invention by persons of limited skills.

4 Claims, 21 Drawing Figures

114
118
120
124
126
108
122
112
114
30

10
16
28
136
134
128
130
110

POWDER ROOM AND BATHROOM SYSTEM AND METHOD OF ASSEMBLING SAME

This is a division of Application Ser. No. 514,807, filed Oct. 15, 1974 and which issued as U.S. Pat. No. 3,978,529 on Sept. 7, 1976.

BACKGROUND OF THE INVENTION

1. Field of the Invention

This invention relates to pre-engineered modular powder rooms, bathrooms and components thereof, and a method of assembling same.

2. Description of the Prior Art

Conventional powder rooms, bathrooms and the like are generally completed by installing simultaneously, the rough plumbing into the "wet wall" of the room and the fixtures of the bathroom or powder room. It is always necessary to cut the pipe members and required components to the proper size in-situ in order to adapt them for assembled installation in the room space designated for the facility. This time consuming procedure often necessitates excessive waste and substantial material costs while necessitating ever-increasing labor costs to assemble the facility. In addition, it is always impossible to finish or to provide any decorative finishing to the wall surface of the room before the fixtures have been installed. This makes it necessary to provide such finishing decorations only after the time consuming task of assembling the room components has been completed. Ever-increasing risks must be taken that the powder room or bathroom components — which are often formed of porcelain or china — will be damaged during the heavy plumbing installation procedures.

Attempts have been made to simplify and reduce the costs of assembling such facilities, however none have been successful in anticipating all of the inherent problems sufficiently such that they may be "designed" out of the system before the elements are produced and/or installed. U.S. Pat. No. 3,230,549 to G. McMurtrie et al relates to a Modular Frame Construction and Installation of Bathroom Fixtures to be installed in a building. The frame construction is intended to support components such as plumbing fixtures; however, unlike my invention it is nevertheless necessary to install all the requisite pipes and pipe chase in the wet wall in a conventional manner. U.S. Pat. No. 3,221,454 to G. Togni relates to a Pre-Fabricated Utility Building Assembly in which a frame section is provided having pre-assembled household plumbing mounted therein such that it may be mounted bodily and embedded within a building structure. U.S. Pat. No. 3,765,036 to D. P. Dykstra relates to an assemblage of Modular Laboratory Cabinets adapted to be positioned along a wall for use in a laboratory room and the like. U.S. Pat. No. 3,707,165 to J. S. Stahl relates to a wall unit having integrally formed surface panels and a foam core which encloses, supports and positions hot and cold water pipes drain and vent piping with electrical wiring. None of these patents disclose or suggest an assemblage of pre-dimensioned and pre-engineered modular components to facilitate the provision of a powder or bathroom even similar to the assemblage which I have invented. Other related prior art patents are as follows: U.S. Pat. No. 3,790,967 to J. M. Pignato relates to a Water Closet; U.S. Pat. No. 3,620,246 to Shoquist relates to a plumbing apparatus for draining water from tubs, commodes, etc. in a limited vertical space and with a single sewer connection.

U.S. Pat. No. 2,027,371 to R. L. Davison relates to a Factory Fabricated Rough Plumbing Unit. U.S. Pat. No. 3,694,973 to D. Unger relates to Utility Module for Apartment-Type Dwellings. U.S. Pat. No. 2,004,933 to R. L. Davison relates to a Bathroom Unit. U.S. Pat. No. 2,653,357 to J. F. Sanders et al relates to a Prefabricated Plumbing Installation; U.S. Pat. No. 1,978,842 to P. R. Hooton relates to a Building Construction having a built-in fabricated metal bathroom. None of these patents disclose or suggest an assemblage of modular units or a method of assembling same to provide a bathroom or powder room such as I have invented. Other prior art patents related to the subject matter of the present invention are as follows:

U.S. Pat. No. 2,787,027 to A. A. Baker
U.S. Pat. No. 2,901,780 to G. G. Rothenstein
U.S. Pat. No. 3,143,744 to H. R. Greer
U.S. Pat. No. 3,740,908 to J. W. Moore My invention makes it possible to quickly assemble a plurality of pre-dimensioned and pre-engineered modular units to form either a powder room or bathroom in a limited room space which may be unfinished, partially finished, or completely finished, in a simplified manner which eliminates all excessive costs while providing a superior installation. Moreover it is now possible for an individual having limited skills to assemble such a facility due to the simplified method which I have invented.

SUMMARY OF THE INVENTION

An assemblage of a plurality of pre-dimensioned and pre-engineered modular units forming at least a powder room within a room section of a building structure wherein an interface frame is mounted in adjacent relation to a wet wall of the room, the wet wall having the piping system of the building structure extending therethrough and the interface frame being formed of structural frame members so dimensioned and capable of being connected as to selectively establish at least the locating positions of a modular toilet bowl and lavatory section along the wet wall of the room. A drain-waste-vent pipe unit is supported substantially vertically in the wet wall of the room and connected to the drain-waste-vent pipe system of the building structure. Drain-waste-vent pipe members are connected in end-to-end relation and supported within the interface frame to form an interface unit comprising a drain-waste-vent pipe system for the room. The invention further comprises means for connecting at least the outlet drain portions of modular powder room fixtures thereto, and means for connecting the venting system of the interface unit to the venting system of the building. A modular pre-dimensioned toilet bowl is supported on the floor of the room and positioned adjacent the frame unit at the toilet position thereof, the toilet bowl having a flush water inlet and a waste outlet at the rear portion thereof with means to secure the rear portion of the bowl against the interface frame unit. A substantially finished shroud member is positioned about the toilet bowl and adjoins the interface unit, the shroud having a flush water supply and control means adapted to selectively direct flush water to the rear inlet portion of the toilet bowl. The invention further comprises means to connect the rear waste outlet of the toilet bowl to a waste inlet opening of the drain-waste-vent pipe unit and a lavatory section positioned against the interface frame unit at the lavatory portion of the interface frame. The lavatory section has a modular cabinet member, a wash bowl supported on the cabinet member having a water supply and control means and having means connecting a drain outlet thereof to the drain inlet opening of the drain-waste-vent pipe system of the interface frame unit, and a finished shroud positioned above the wash bowl and cabinet. The invention further comprises water supply means connecting the building water supply to the toilet bowl and water supply system of the wash bowl. The interface unit and pipe system of the present invention conveniently establish a template for at least a powder room such that the modular fixtures may be conveniently installed in the room section of the building structure after at least a portion of the room has been finished, particularly due to the convenient wall surface mounting capability of the interface unit. This convenience is also extended to provide the capability of assembling the powder room according to numerous arrangements such as in a left hand arrangement, a right hand arrangement, or multiple facilities in back-to-back relation, etc. This advantage is particularly due to the symmetrical and interchangeable features of the members forming the interface core which make it possible to assemble the core according to a plurality of arrangements.

In another embodiment the invention further comprises a bathtub section connected to the interface frame unit with an assemblage comprising additional drain-waste-vent pipe members, a bathtub portion extending the interface frame to support the bathtub section of the pipe system, a uniquely configured bath tub and wall surround members which complete the assemblage to form a full bathroom.

The prefabrication of the components form rapidly and easily installed powder rooms or bathrooms having left hand arrangements in single or multi-storied buildings and installed either as single bathrooms or powder rooms or in a multiplicity of back-to-back arrangements with other bathrooms, powder rooms, kitchens or utility rooms. Although it is primarily contemplated to be utilized with residential structures, the invention is also suitable for use in other types of structures requiring washroom or bathroom facilities. Further, the invention can be installed in a pre-finished or finished decorated room as well as being applicable to all current building methods. It is particularly suitable for installation in new buildings or in the renovation of old buildings and requires no more area in a building than that conventionally assigned for bathrooms or powder rooms. As will be seen in the description which follows, the invention facilitates easy access for any needed repairs or replacements without effecting any finished wall, floor or ceiling surface, and it does not encompass any secondary or duplicated wall, floor or ceiling structures. Further, it does not preempt conventional room construction or surface materials and complies with existing plumbing codes while allowing for variations in plumbing codes as they may vary from place to place. It allows for individual selection of room colors and decorations rather than commercially selected colors, textures, patterns and combinations thereof which may or may not be suitable to the individual.

It will be seen that the invention broadly relates to at least four basic elements which provide the basic flexibility of the arrangement as follows:

1. The drain-waste-vent pipe unit.
2. The wall surface mounted interface unit formed of an interface frame having drain-waste-vent pipe members connected in end-to-end relation and supported within the frame.
3. The toilet section.
4. The lavatory section.

By incorporation of a fifth section in the form of a bathtub section, a complete bathroom is formed.

The interconnecting means utilized in combination with pipe members such as water lines, vent lines, drain lines, etc. contemplate the use of any of a plurality of currently available connecting means such as thread members, unions, sweated joints, snap-on devices and the like used with pipe members manufactured of suitable materials such as iron, copper, brass, plastics and the like. Any suitable means to secure the pipe members in position within the interface frame such as clips, snap-on devices, etc., are also contemplated.

It is also contemplated within the scope of the invention to incorporate an interface unit in the form of a frame section having a manifold section in which the pipe members are formed from at least two plate sections joined in back-to-back relation, each having tunnel like formations in face-to-face relation with each other to form conduits which will comprise the pipe members of the unit.

The invention also pertains to a uniquely configured modular toilet bowl which is floor supported and which has a flush water inlet and waste outlet at the rear portion thereof so as to facilitate a single step attachment to the corresponding toilet section of the interface unit or to a wet wall. Still another feature of the invention pertains to a uniquely configured bathtub which is peculiarly adapted for installation into the bathroom of the invention due to its arcuately configured end portion which makes it possible to conveniently rotate it into position into the bathtub section of limited dimensions. A significant advantage of my invention relates to the capability of installing the powder room and bathroom components after the room is finished or semi-finished. This minimizes the risk of damage to the components which are often manufactured of breakable materials such as china. The risk is inherent when a unit such as a china or glass bathtub, wash bowl, or toilet bowl is installed requiring rough plumbing for the necessary connections. According to my invention all of the rough plumbing is completed prior to the installation of the room components.

The invention also relates to a method of assembling a plurality of pre-dimensioned and pre-engineered modular units to form at least a powder room within a room section which comprises: taking the structural members of an interface frame unit; selectively assembling said structural members to form an interface frame having at least two sections, one section defining a toilet position, the other section defining a lavatory position; selectively assembling a drain-waste-vent pipe system for the powder room; installing the drain-waste-vent pipe system within the interface frame to form a drain-waste-vent interface unit for the powder room; installing a drain-waste-vent pipe unit substantially vertically in a wet wall of a room section of a building structure; installing a modular pre-dimensioned toilet bowl against the interface frame unit; installing a modular pre-dimensioned cabinet against the interface frame unit to define a lavatory section of the room; installing a modular wash bowl on the cabinet; installing a modular pre-dimensioned medicine cabinet on said interface frame unit at said lavatory section, the cabinet having lighting means attached thereto; providing electrical power from said building power supply to the lighting means; and supplying water to the fixtures by connecting water supply conduits from the water supply of said building to the fixtures.

The method of assembling the bathroom of the present invention further comprises: selectively assembling structural members to form an interface frame bathtub section; installing a modular pre-dimensioned bathtub within the room at the bathtub location of the frame unit; installing a first finished pre-dimensioned shower wall surround over the forward portion of the bathtub; installing a second finished pre-dimensioned shower wall surround over said bathtub in adjacent relation to the first wall surround and interlocking the adjacent end portions thereof to maintain them securely in position; installing a third finishing pre-dimensioned shower wall surround over the rear portion of said bathtub and connecting the end portion adjacent the second surround with the end portion of said second wall surround; installing a water supply spout in a manner to extend a portion thereof through the first wall surround and attaching the spout to the interface frame unit to secure the wall surround in position; installing an escutcheon having a securing member by extending the securing member through the first wall surround and connecting the member to an attachment member attached to the bathtub section of the interface unit to further secure the first shower wall surround; installing a shower head having a water supply pipe and bracket means by extending the bracket means through the first shower wall surround and connecting the shower head to a water supply pipe; and installing a shower curtain rod between the first and second wall surround to maintain the positions of the wall surround so as to form a finised shower enclosure.

DETAILED DESCRIPTION OF THE PREFERRED EMBODIMENTS

Figure 1:
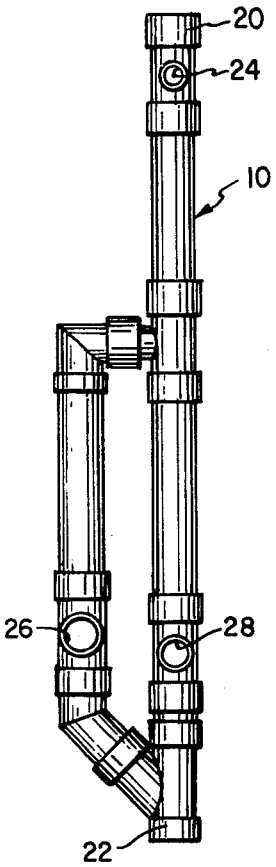
FIG. 1 is a view of a Drain-Waste-Vent Pipe unit (DWV Stack) intended for use with the present invention.

In the following description, the expression "Powder Room" contemplates a water closet, washroom, toilet and the like, while the expression "Bathroom" contemplates a full bathroom which may include a powder room and bathtub section — with or without a shower — in combination.

The invention is comprised of five modular basic elements, segregated according to function. Each element contains one or more prefabricated components and each component can be factory assembled to various degrees of completion, at option. Accordingly the degree of in-field assembly can be varied as economics or local labor practices require. The five basic elements are:

1. The Drain-Waste-Vent pipe unit (DWV Stack) 10.
2. The wall surface interface frame 12 of the interface unit 30.
3. The bathtub/shower section 14.
4. The toilet section 16.
5. The lavatory section 18.

Referring to FIG. 1 there is illustrated a drain-waste-vent pipe unit 10, sometimes referred to as a DWV Stack. The drain-waste-vent pipe unit is an assemblage of drain-waste-vent pipes and fittings which are conventionally connected to the drain-waste-vent system of the building structure at end portions 20 and 22 and contains a drain waste and venting configuration as shown. It is installed in the piping chase of the "wet wall" of a room section of the building.

According to normal practice, installation of this stack is generally accomplished at the time the rough plumbing of the building is installed with the only particular requirement being that the drain-waste-vent pipe unit is properly positioned in relation to the finished floor line and with a selected wall of the bathroom of powder room. This positioning is generally accomplished by means of a jig (not shown) and assures proper connection with the piping components of the system at the three open positions 24, 26, and 28. The drain-waste-vent pipe unit 10 may be either factory of field assembled but must conform to specific dimension requirements to insure proper interconnection with the piping components of the drain-waste-vent piping system associated with the room and the building structure.

Certain variations of the drain-waste-vent pipe unit may be required for different applications. For example, one version of the type shown in FIG. 1 is intended to be used with a single bathroom or powder room. A second version may be used for back-to-back bathrooms or powder rooms where interconnections must be made to pipe components on both sides of the "wet wall" or piping chase as will be seen in the description which follows. These multiple pipes are generally intended for structures such as high rise buildings in which powder rooms or bathrooms are positioned in back-to-back relation. However multiple installations would naturally require larger diameter vertical pipes to accommodate proportionately higher volume of waste.

Figure 2:
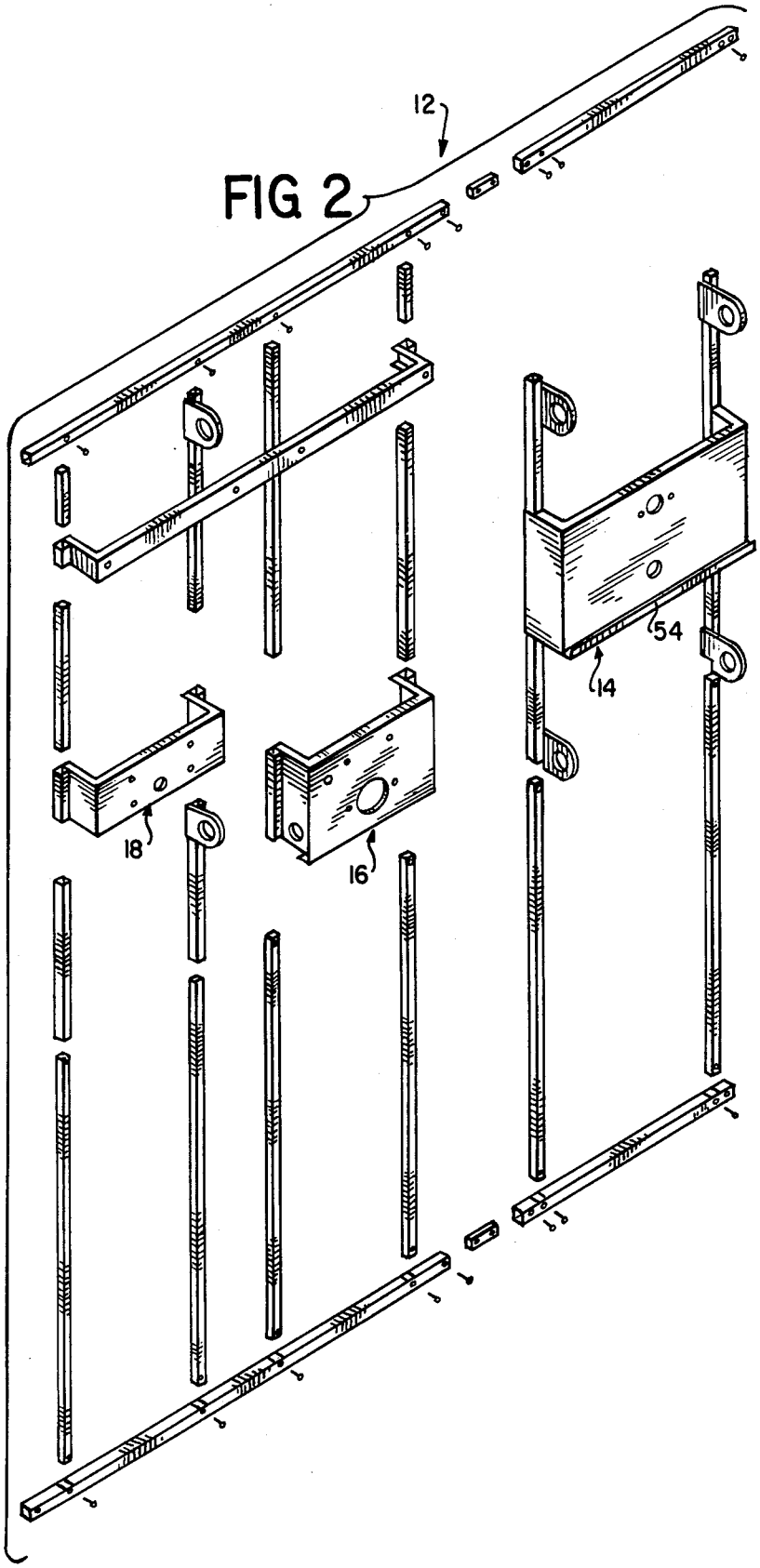
FIG. 2 is an exploded perspective view of the components forming an interface frame intended for selective assembly and use as the frame of the piped interface unit of the present invention.
Figure 4:
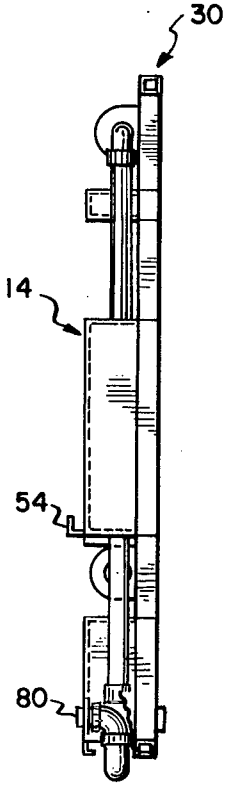
FIG. 4 is a side view of the interface unit of FIG. 3.
Figure 3:
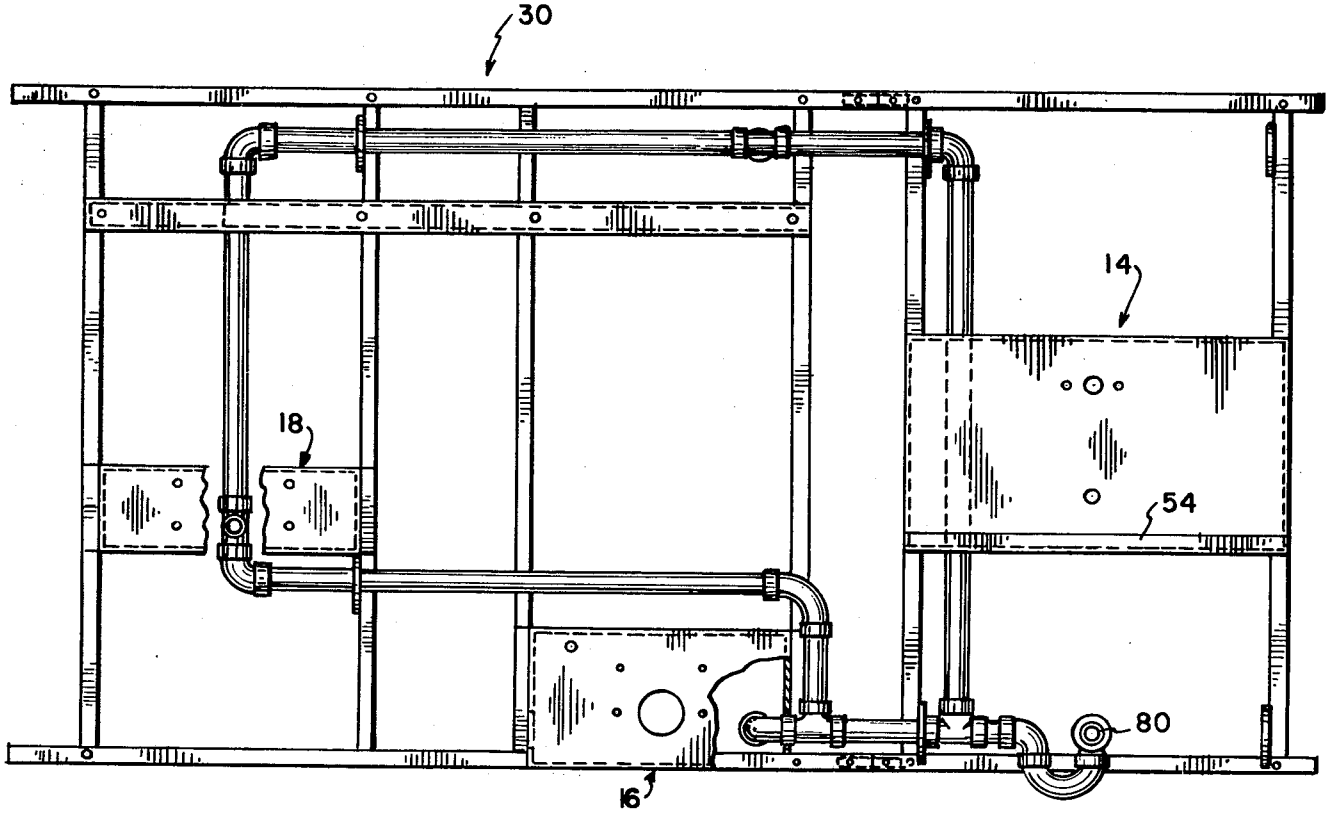
FIG. 3 is a view of an assembled interface unit with the Drain-Waste-Vent pipe system installed as intended for use with a full bathroom of the present invention.
Figure 6:
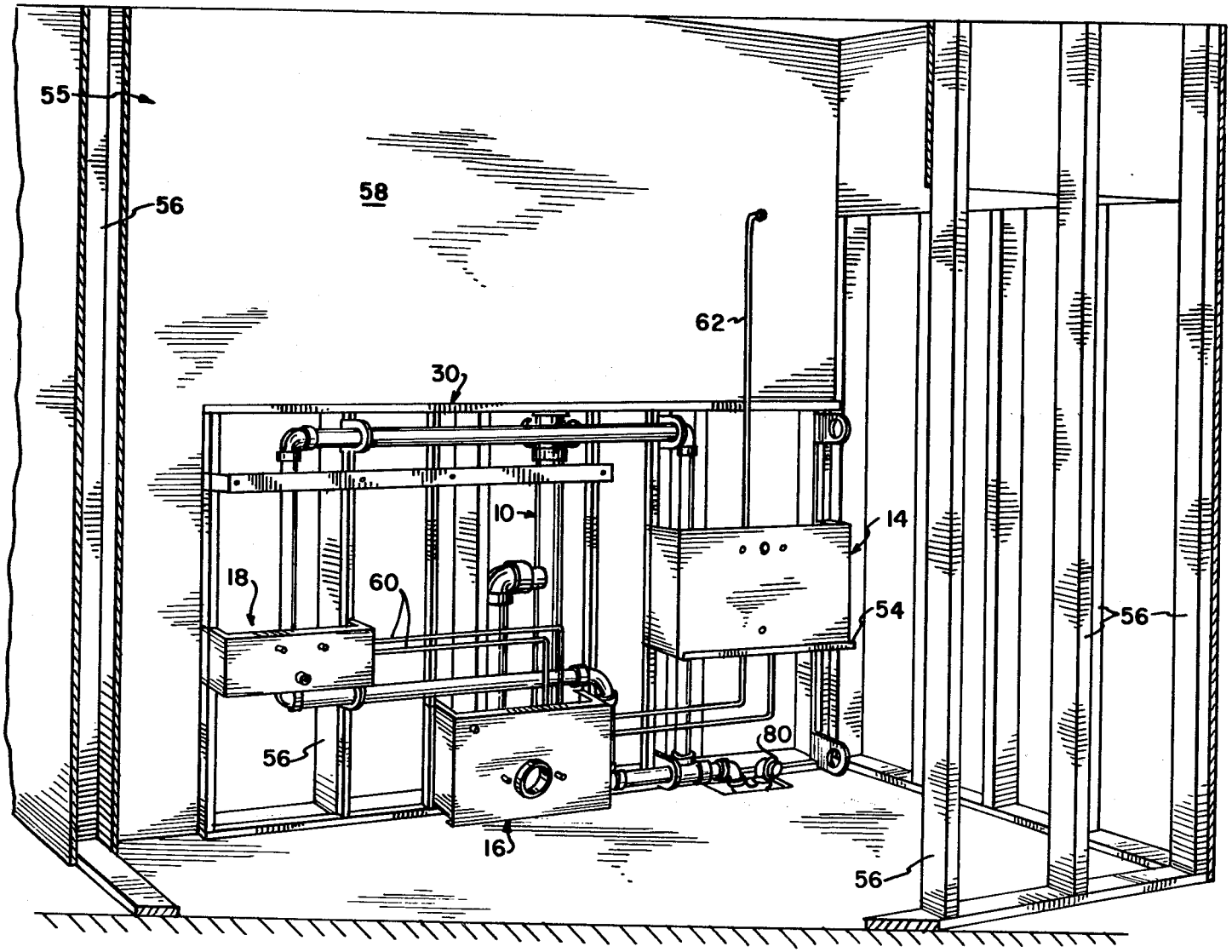
FIG. 6 is a perspective view of the room of FIG. 5 with the interface unit, Drain-Waste-Vent pipes, and water supply lines secured in position.

Referring now to FIG. 2 there is shown the component frame members and brackets of a structurel unit 12 which upon assembly, form an interface core structure which supports the drain-waste-vent pipe unit and the drain-waste-vent piping system associated with the room. The interface structure is comprised of three major elements and forms the basic template for a full bathroom when assembled and installed in a room as shown in FIG. 6. The three major elements shown in FIG. 2 comprise templates 14 for the bathtub section, 16 for the toilet section, and 18 for the vanity sink section, each being telescopingly connected to the vertical and horizontal support members as shown in FIGS. 2, 3 and 4. Alternately, by merely eliminating the bath section, the basic interface core provides a template for a powder room.

The interface frame sections are rigid members which may be factory assembled or assembled in-situ to form a planar frame to conform it to the particular requirements of a specific installation. The components of the structure are preferably fabricated of a metal such as steel, iron, brass, etc. However, the frame may be of plastic materials since most of the in-room elements are floor supported and the only strength required in the frame must be sufficient to support the interface piping and to secure the positioning of in-room elements. The elements of the frame structure may be secured together by threadedly engaging the components, or by bolts, screws and the like, but are preferably assembled by telescoping the sections and securing them with screws, bolts, clamps, etc. or by a snap-together arrangement.

Referring now to FIG. 3 the structural interface frame 12 of FIG. 2 is shown in assembled form 30 with the drain-waste-vent piping system 32 through 52 secured in position. The assembly shown in FIG. 3 is suitable for use in a full bathroom (ie. bathtub section, toilet section and vanity sink section). As can be seen in the drawings, the drain-waste-vent interface unit 30 provides a convenient layout of the bathroom of powder room with dimensions conforming to the requirements of the particular room in which the installation is to be made. FIG. 4 is a side view of the interface unit of FIG. 3 and illustrates a bathtub support 54 which supports the forward portion of the bathtub as will be seen in the description which follows.

Figure 5:
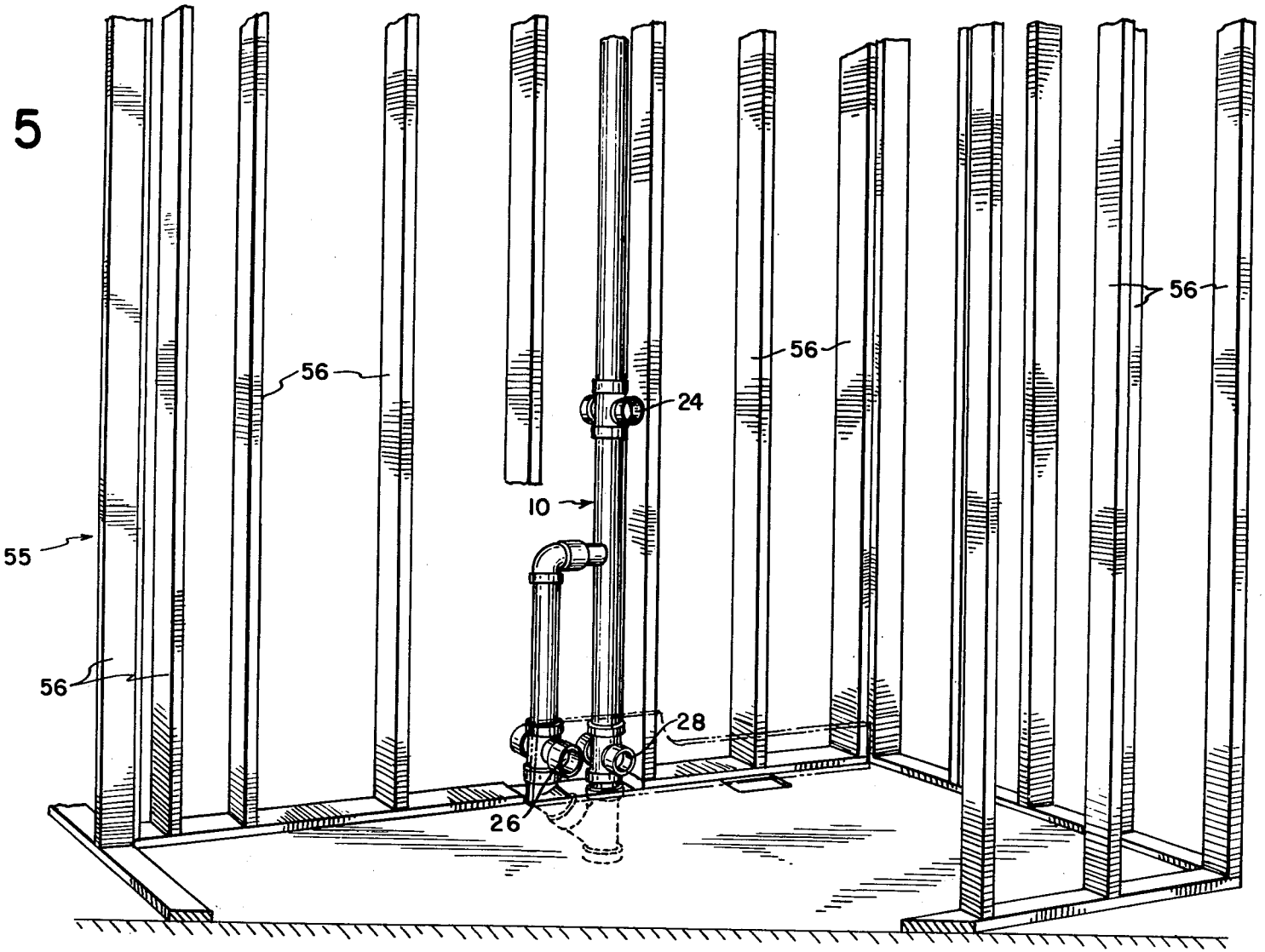
FIG. 5 is a perspective view of a basic room section of a building structure with the Drain-Waste-Vent pipe unit of FIG. 1 installed in position and connected to the Drain-Waste-Vent pipe system of the building.

Referring now to FIG. 5 there is shown an unfinished room 55 framed with studs 56 in which the drain-waste-vent pipe unit 10 of FIG. 1 is installed and connected to the drain-waste-vent piping chase of the wet wall of the room section of the building structure. The drain-waste-vent pipe unit must be positioned with the "wet wall" of the building as shown — prior to any other installations — with the dimensional position requirements with respect to the finished room strictly adhered to as previously noted.

Referring to FIG. 6 there is illustrated the room 55 of FIG. 5 with the interface unit 30 of FIG. 3 floor supported and installed in adjoining relation to the wet wall 58. It is secured to the "wet wall" by conventional securing means such as nails, screws, etc., preferably with the bathtub end of the frame in contact with the tub wall studs or rough wall. This assures proper alignment of the three interconnections between the interface piping and the drain-waste-vent pipe unit. For a powder room only, the interface unit will be secured in contact with the lavatory wall at the toilet end in which case proper alignment of the two interconnections will be assured. Water supply lines 60 are installed and a shower riser pipe 62, if required, is positioned adjacent the bathtub bracket 14 of the interface.

A feature of the present invention resides in the capability of installing interface unit 30 — or even the entire powder room or bathroom — in position against the "wet wall" after the upper portion of the walls of the room have been completed and finished (painted, wallpapered, etc.). The interface unit, being a surface mounted pre-piped unit — which is not required to be integrally assembled as part of the basic structure of the room — is thus suitable for original or prime installations or for powder room and bathroom conversions.

The connections between the pipes and the drain-waste-vent pipe unit 10 are preferably of the type generally used with the pipes selected in a particular installation. For example, the pipes may be comprised of brass, iron, etc. Accordingly, the pipe connections will be unions, elbows and the like, of iron or brass. Copper pipes will be connected by connecting means generally used with such members such as sweated joint connections. Also the hot and cold water supply lines 60 to each fixture may be of the type generally used according to local practice. For example, these lines may be the form of copper tubing sweated to the supply piping of the system.

Figure 7:
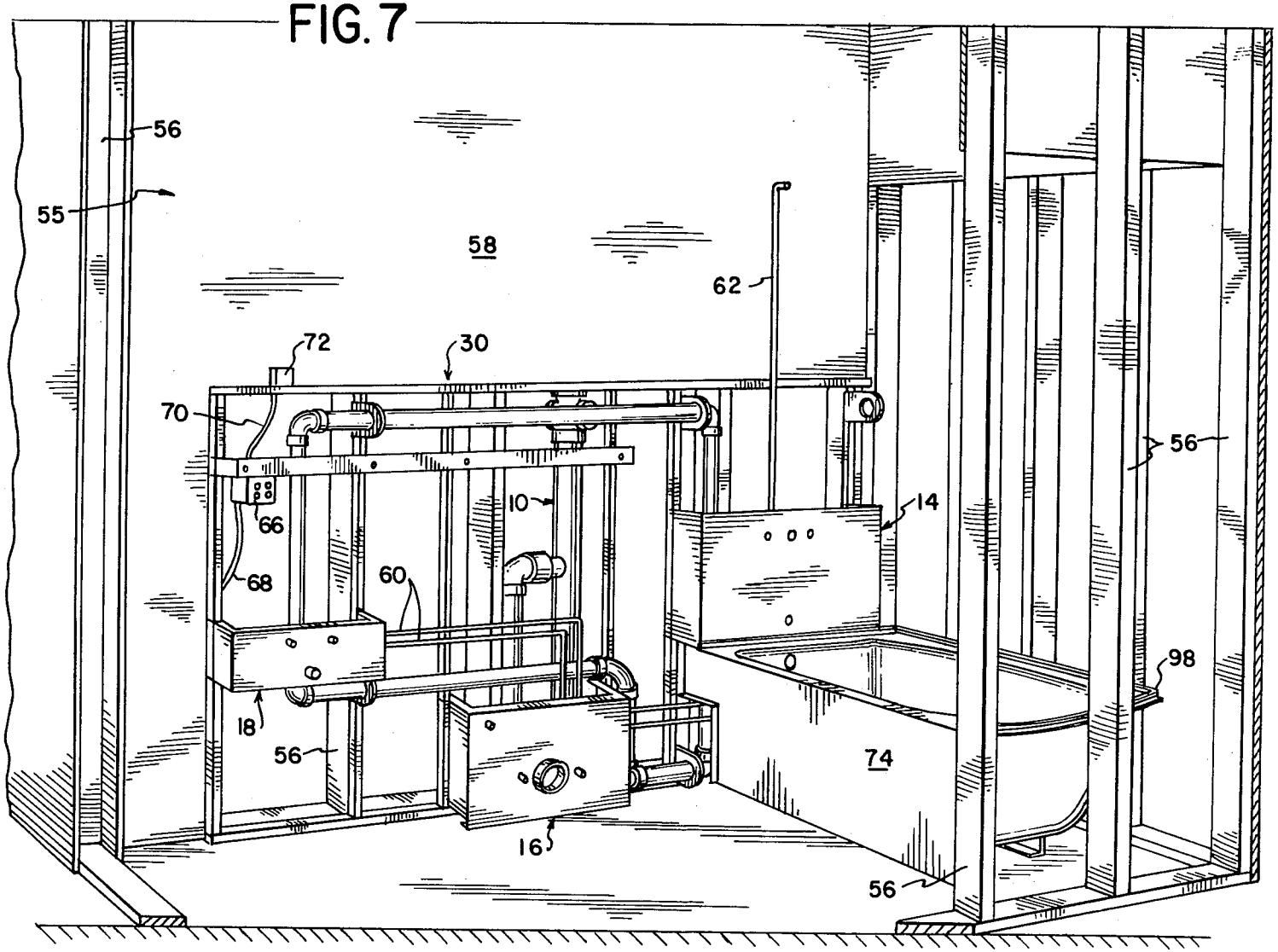
FIG. 7 is a perspective view of the room of FIG. 6 illustrating the bathtub of the present invention in position.

Referring further to FIG. 7, an electrical junction box 66 is provided as part of the lavatory portion of the frame. This permits interconnection between the building wiring 68 and the room lighting, which — as will be seen — is attached to a medicine cabinet component of the modular lavatory section. Wiring 70 from the junction box 66 extends to an electrical recepticle 72 located at the top center of the lavatory section of the interface frame.

After completion of the installation as illustrated in FIG. 6, the basic plumbing system is complete and in those geographical locations in which local rules may require, the plumbing (local or other) inspector may inspect and perform the necessary tests of the system with complete access to all components, connections and joints. Thus in the event further work is required to comply with local codes and practices, this may be detected and corrected prior to proceeding further.

The bathtub/shower section is comprised of four major components: the bathtub and a three-piece wall surround. The bathtub is a free standing, floor-supported unit with a factory fitting overflow drain assembly. It is so configured that it can be brought into a finished (or a partially finished) room, placed in position against the tub wall and the face of the interface unit bracket 54, and then lowered to the floor.

FIG. 7 illustrates the installation shown in FIG. 6 with the bathtub 74 of the present invention installed into position. The installation of the modular bathtub 74 of the present invention is peculiarly applicable to the present system as will be described in connection with FIGS. 8 and 9. The position of the bathtub 74 is determined by the interface unit 30. The bathtub 74 is secured in position by the three-piece wall surround. The forward portion 76 of the tub 74 engages the lip 54 of bracket 14 of the bathtub section of interface unit 30.

Figure 8:
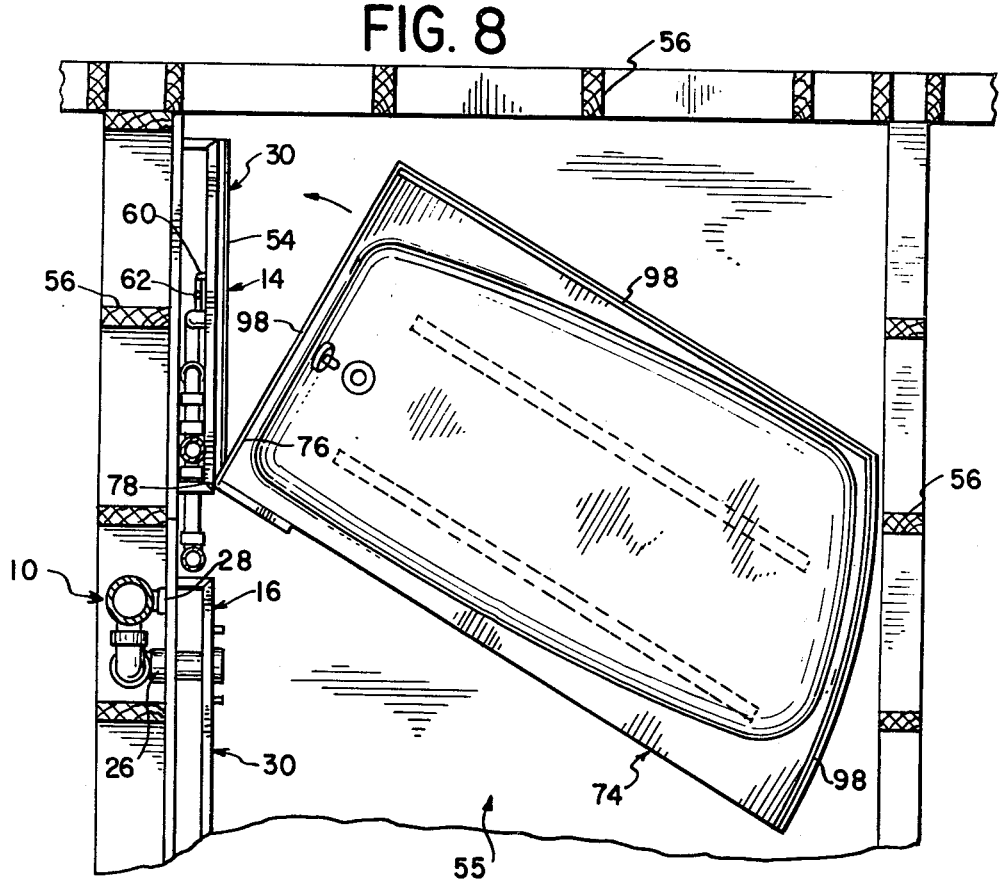
FIG. 8 is a top view of a portion of the room of FIG. 7 illustrating the installation procedure intended for use with the bathtub of the present invention.

The bathtub 74 shown in FIG. 7 is uniquely configured to have an elongate configuration with one arcuate end portion as shown. It may be constructed of conventional materials such as enamel iron, enameled steel, plastic materials, and the like. Preferably the bathtub will be approximately 16 inches high so as to permit it to pass through a standard doorway 2 feet in width. It is approximately 30 inches wide in accordance with established standards for residential bathrooms and it is approximately 55½ inches long and particularly configured to have a radiussed arcuate configuration along one of the shorter sides as shown in FIG. 8. The center of the radius of the arcuate side of the bathtub is preferably located approximately at the lower left hand corner portion 78 of forward portion 76 of the bathtub as shown in FIG. 8. With this configuration the bathtub can be simply fitted into the room after all heavy plumbing and structural work has been completed and then rotated snugly into position in the bathtub end of the room structure and supported on hanger rails 58 as shown in FIG. 7. Thus with all structural and plumbing work completed prior to its installation, the risk of damage to the finished surface of the bathtub is minimized. This risk was generally substantially great in prior art installations during the performance of the structural and plumbing work in the room. For the same reasons the risk of damage to the remaining modular fixtures of the present invention is substantially eliminated.

Figure 9:
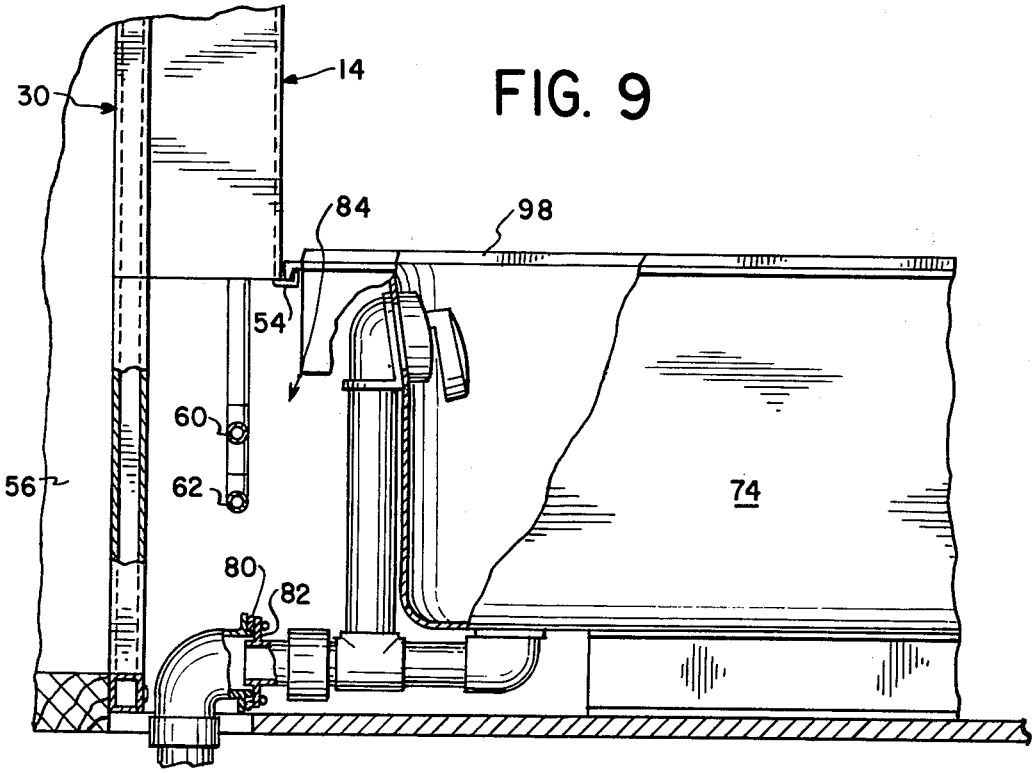
FIG. 9 is a side view of the forward portion of the bathtub of FIG. 8 partially in cross section, illustrating the tub drain pipe connection with the interface unit of the present invention.

Referring now to FIG. 9 there is illustrated a side view of the lower forward end portion of the bathtub in which the bathtub drain fitting is connected to the drain-waste-vent system of the room. While it is preferred that the drain connection 80 is accomplished by a quick-connect clamping unit 82, since certain local codes will not permit them, it is also contemplated within the scope of the present invention to connect the drain system of the bathtub by conventional means such as threaded pipes, unions, etc. (not shown). The opening 84 defined by the forward left-hand side wall of the bathtub 74, is later covered by a shroud section of the modular toilet bowl as will be seen. The bathtub may be provided in left and right-hand versions to accommodate installations as shown, or installations having a "mirror image" of the installation shown.

It is clear that the modular aspects of the present bathtub provide particular convenience in the installation, repair and/or replacement thereof. Also, the combination of the wall surface mounted interface unit 30, and the bathtub 74 may be installed within several hours thereby avoiding the high costs of labor which were normally incurred during comparable installations of the prior art. The forward open position of the bathtub of the present invention permits ready access for repairs as contrasted to prior art bathtubs in which leaks, for example, were generally so difficult to repair — due to the inaccessibility of the drain supply connections to the tub — that often the cost approached the cost of a new bathroom.

Figure 10:
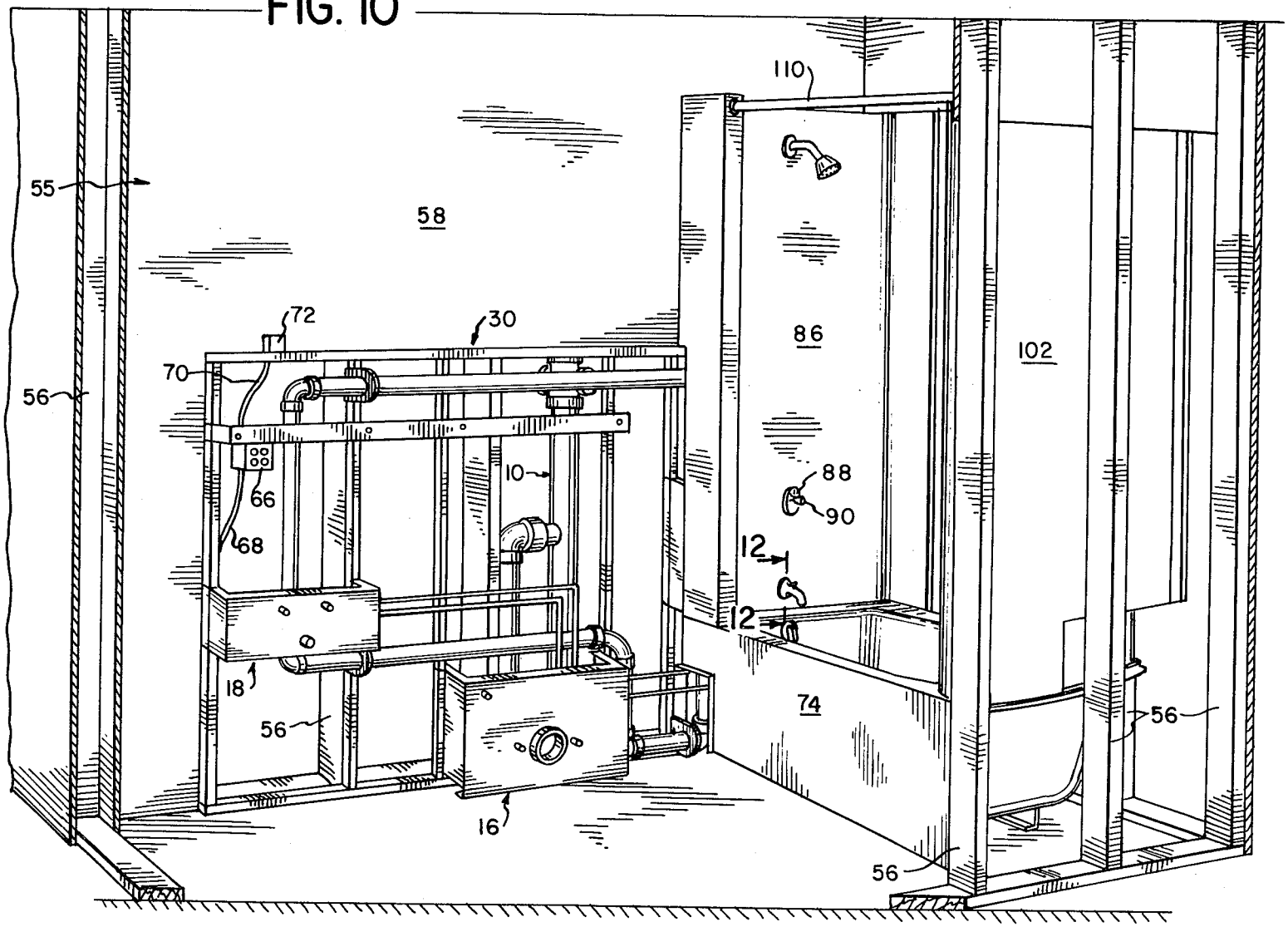
FIG. 10 is a perspective view of the room of FIG. 9 with the bathtub/shower wall surround members secured in position.
Figure 11:
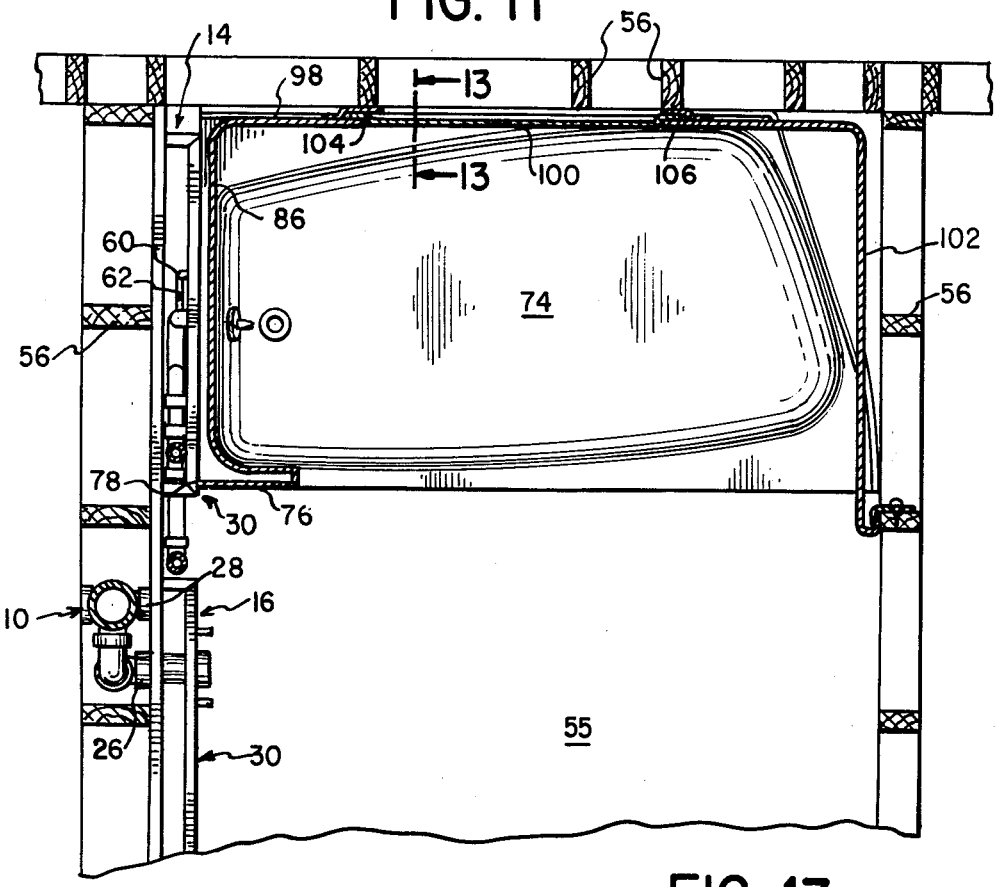
FIG. 11 is a top cross sectional view of the tub and wall surround section of the room of FIG. 10.
Figure 12:
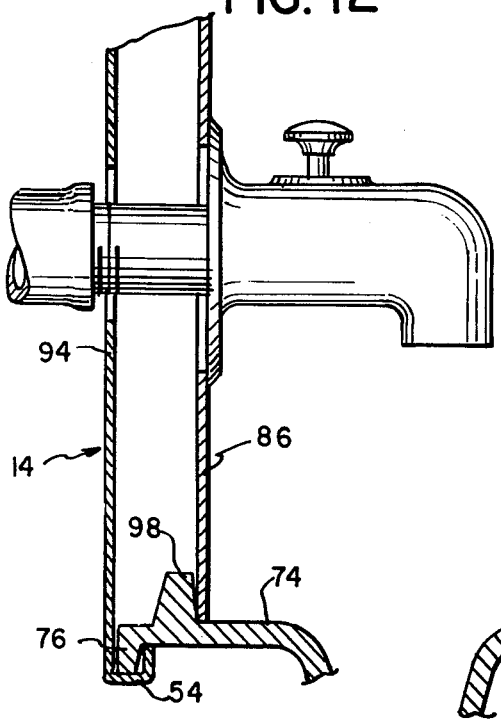
FIG. 12 is a view taken along lines 12—12 of FIG. 10.
Figure 13:
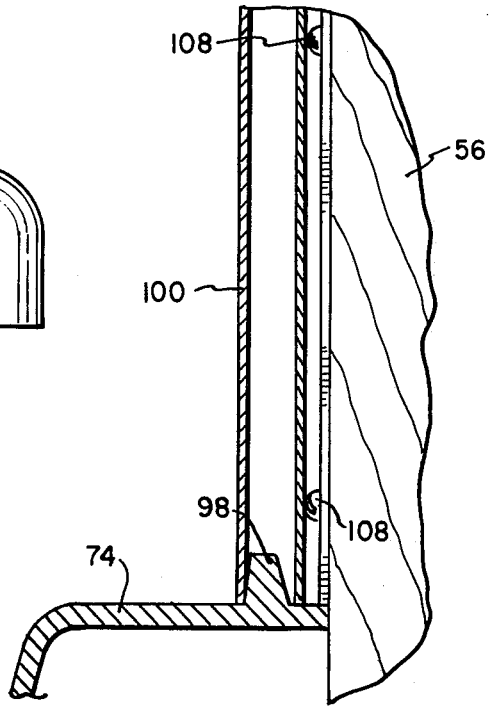
FIG. 13 is a view taken along lines 13—13 of FIG. 11 illustrating the method of securing a bathtub/shower wall surround member in position.

In FIG. 10 there is illustrated, the bathroom shown in FIG. 9 with the first wall surround panel member 86 secured into position over the forward portion of the bathtub. The panel 86 is preferably secured in position by the shower head 62 which is threadedly engaged into the riser pipe system behind the panel in a manner which secures the panel against the structure as shown in FIG. 12. Further securing of the wall surround 86 may be accomplished by rotating the threaded escutcheon 88 surrounding the shower-tub water supply lever 90. The escutcheon 88 is threaded into a bathtub bracket attached to the interface frame 12 of interface unit 30 (not shown). Referring further to FIG. 12 there is illustrated a unique "tongue and groove" feature of the wall surround member 86 whereby the lower portion is spaced from the lower portion 94 of the bathtub/-shower section 14 of the interface unit 12 to define a slotted lower portion surrounding a lip (or ledge) or bathtub 74. The ledge 98 engageably enters the slot defined by the lower portion of the surround to create a "water barrier" in the form of a water-tight seal about the periphery of the bathtub and acts to secure the bathtub in proper position, as described in connection with FIG. 7. Referring now to FIG. 13, the interconnection between the second shower wall surround member 102 is secured in position similarly to wall surround member 86. The third wall surround member 100 is positioned by a "tongue and groove" arrangement similar to the other wall surround members and the three wall surround members are locked in attached relation by "tongue and groove" arrangements at 104 and 106.

While the wall surround members 86, 100 and 102 are partially secured in position against the studding or interface frame by screws or other fasteners 108 shown in FIG. 13, the final securing is accomplished by positioning a shower curtain rod 110 in position as shown in FIG. 10. The shower curtain rod is preferably adjustable in length such that it can be pre-dimensioned to cause the wall surround members 86 and 102 to be secured in position while providing adjustments for minor dimensional variations in the studded walls. Also, the tongue and groove interlocking system between wall surround members 86 and 100 and members 100 and 102 as described, securely maintain the relative positions of these members.

It can be seen that at this point the basic components of the bathroom are assembled in predimensioned relation. The wall surround members 86, 100 and 102 are uniquely locked into position as described, while providing a water tight seal along the periphery of the tub. The wall surround components may also be provided in right or left-hand versions.

Figure 14:
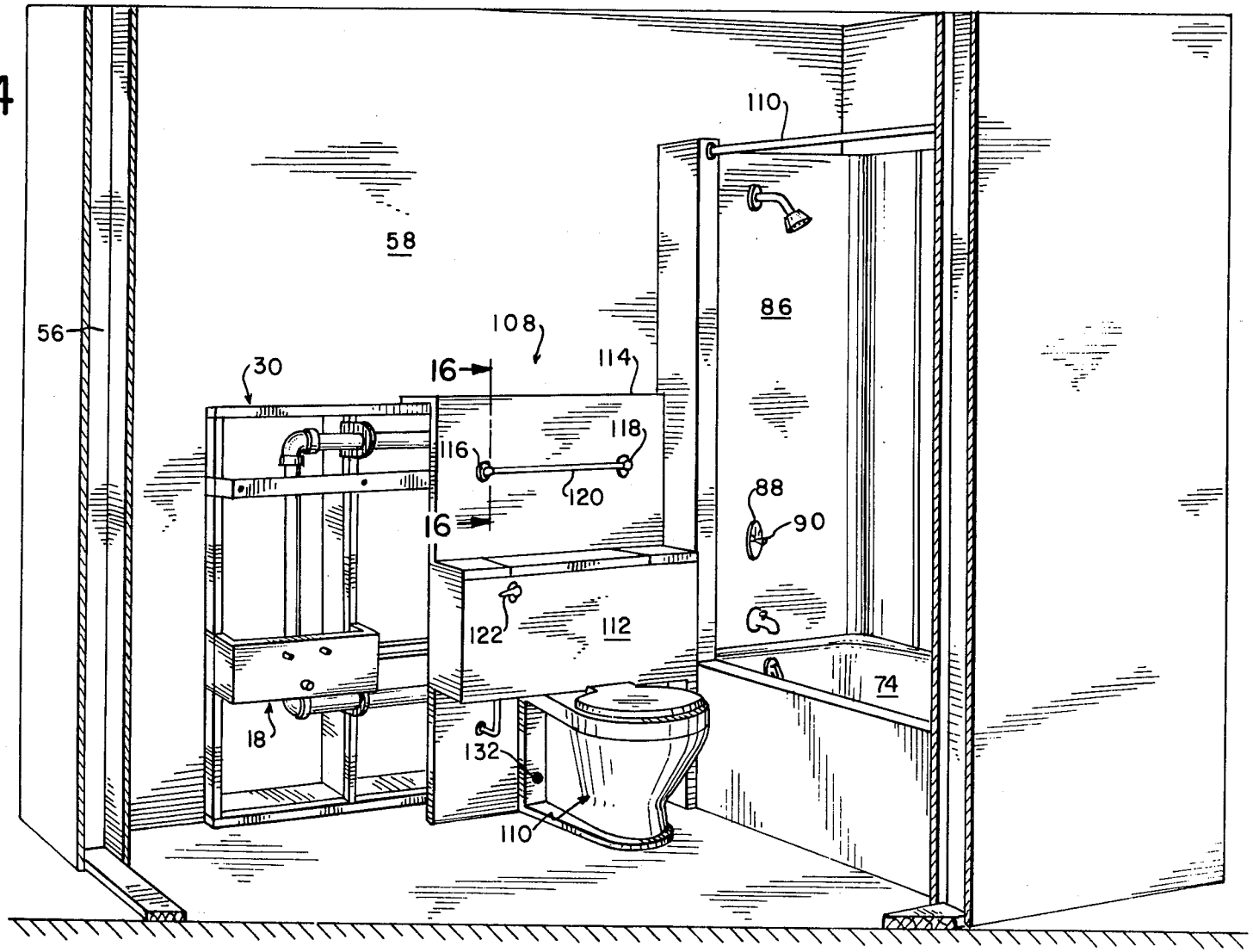
FIG. 14 is a perspective view of the room of FIG. 10 with the toilet bowl and flush water tank shroud installed in position.
Figures 15, 16:
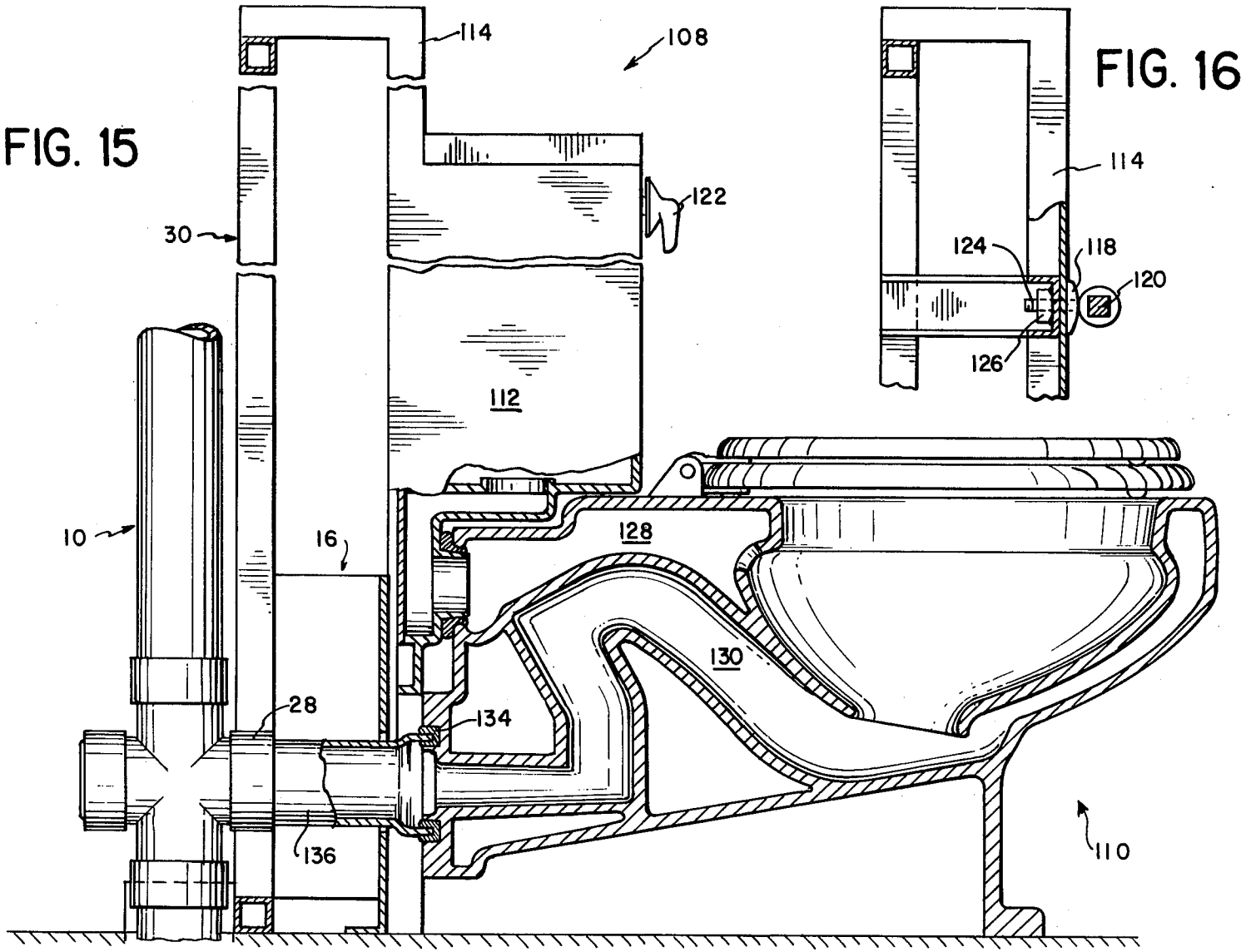
FIG. 15 is a partial cross sectional view of the toilet bowl of the present invention illustrating the unique inlet and outlet features and single step rear mounting feature.
FIG. 16 is a view taken along lines 16—16 of FIG. 14 illustrating the toilet shroud attachment of the towel rack installed according to the invention.

FIG. 14 illustrates the bathroom shown in FIG. 10 with the toilet section 108 installed in position and toilet bowl 110 connected with the drain waste and water supply system by piping means shown in FIG. 15. Water tank 112 is mounted to the interface unit 30 by an associated integral shroud unit 114 which is prefabricated, floor supported, and secured into position by means of towel bar brackets 116 and 118 as shown in FIG. 14. Towel bar 120 is mounted to these brackets. The brackets 116 and 118 have securing means 124 which extend through the shroud 114 and are attached by suitable attachment means such as nuts 126 to secure the toilet section in position against interface unit 30. The flush tank 112 is supplied with a conventional flush valve 122 and control valve and flushing actuating mechanism (not shown).

A unique feature of the toilet bowl 110 of the present invention is clearly illustrated in the cross-sectional view of FIG. 15. By the provision of internal flush water and waste channels 128 and 130, respectively — which extend toward, and are opened to, the rearward face of the toilet bowl unit — it is now possible to secure the toilet bowl for tank-type or pressure-type (commercial) flushing in a single step mounting operation. The toilet bowl 110 is floor-supported and mounted in adjacent relation and abutting with the shroud 114 of the toilet section. The bowl 110 is secured in position by merely threading two bolts 132 (one bolt not shown in FIGS. 14 and 17) sufficient to secure the bowl 110 in position. Referring once again to FIG. 15 an outlet seal ring 134 of a bees wax-type is positioned between the outlet channel 130 of the toilet bowl and the waste pipe 136 which completes the waste line from the bowl to the drain-waste-vent pipe unit 10 through outlet 28. Thus by the provision of a rear water flush-rear waste outlet tank-type toilet bowl, it is possible to install the toilet bowl in position in a single attachment step thereby avoiding unnecessary and expensive labor costs generally incurred in installing systems of the prior art. A conventional toilet seat 138 may be provided is shown in FIG. 14.

Figure 17:
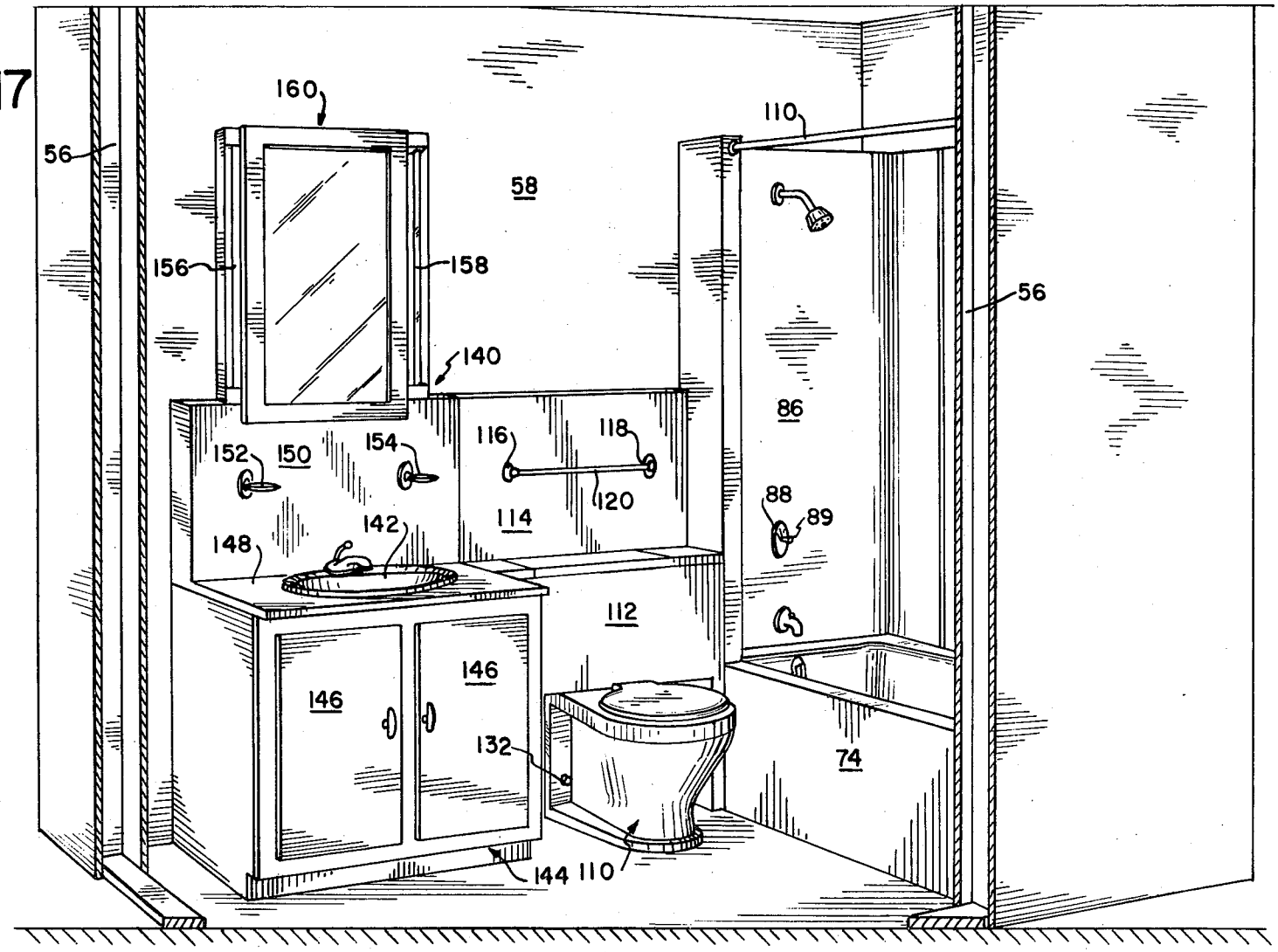
FIG. 17 is a perspective view of the completed bathroom of the present invention with the vanity sink and mirror installed in position.

Referring now to FIG. 17 there is illustrated a perspective view of the completed bathroom of the present invention. The lavatory section 140 included wash basin 142 secured within a full standing vanity cabinet 144 having doors 146 and a lavatory counter top 148. An upper interface shroud 150 is connected to the counter top 148 and is securely mounted to the vanity section as shown and is secured against the interface core unit by decorative accessories such as by threadedly attaching a soap dish 152 and glass and tooth brush holder 154 threaded into the interface unit frame behind the shroud in a manner similar to the attachment of the towel bar bracket attachment shown in FIG. 16. A securing member which forms part of these accessories extends through the shroud and is attached to a bracket member which is secured to the frame of the interface unit.

Once the lavatory section is mounted in position, supply and drain interconnections to the interface unit piping system are preferably completed by using quick flexible connectors (not shown) for water supplies and drains, or alternatively, conventional connecting means as may be required by local plumbing codes. Room illumination may be provided by lights 156 and 158 (fluorescent or other conventional types) which comprise part of the medicine cabinet. The modular medicine cabinet 160 is properly positioned on the top ledge of the upper interface shroud 140 and secured to it by means of two bolts or screws. As it is positioned, an electrical plug engages the electrical receptacle 72 previously illustrated for providing power to the lights 156 and 158.

Figure 18:
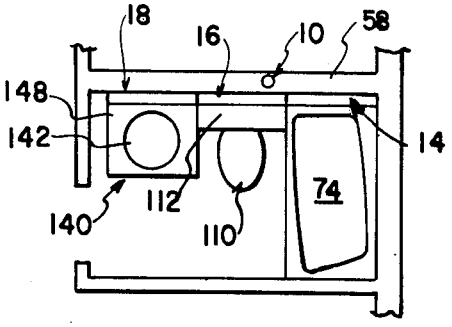
FIGS. 18–21 are views illustrating some of the selective combinations of powder rooms and full bathrooms which are possible with the present invention.
Figure 19:
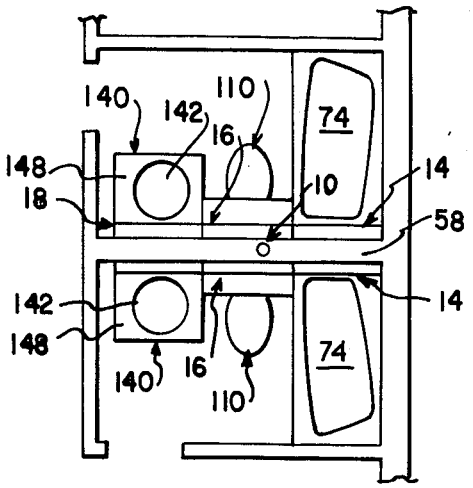
Figure 20:
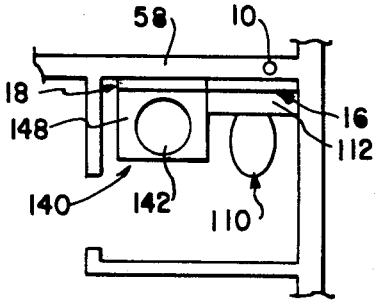
Figure 21:
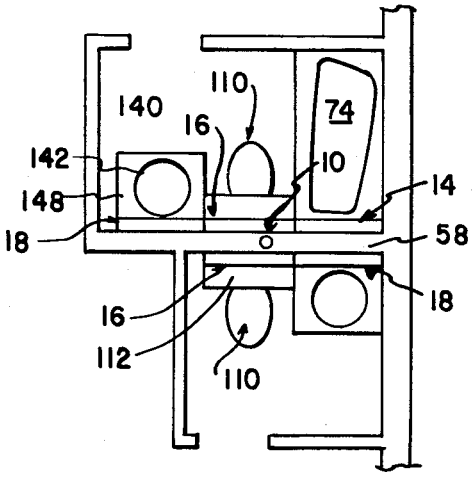

It can be seen from the foregoing description that the modular aspects of the wall mounted interface unit as well as the modular aspects of the fixtures of the washroom or full bathroom make it possible to install a bathroom or powder room in a substantially completed room while reducing the time and labor costs to assemble such facilities. There is illustrated in FIGS. 18 through 21 some of the various combinations and arrangements which are possible utilizing the present invention. Moreover the interchangeable aspects of the components of the present invention make it possible to provide left hand and right hand powder rooms or full bathrooms as shown in FIGS. 18 through 21. In fact, last minute changes from a full bathroom having a tub on the right hand side can be made to convert the arrangement to a full bathroom having the tub on the left hand side by a mere interchange of the tub section of the interface frame and subsequent installations. Further, the tub can be completely eliminated to provide merely a powder room installation. The modular aspects of the present invention facilitate numerous combinations and arrangements of bathrooms, powder rooms and the like which will readily come to the minds of persons skilled in the art. In FIG. 18 there is shown a single bathroom, while in FIG. 19 there is illustrated a single powder room, while in FIG. 21 there is illustrated a full bathroom and a powder room in back-to-back relation.

The versatility and symmetry of the sections of the interface core makes it possible to assemble the modular components of the present invention so as to adapt them to individual needs while the modular aspects make it possible to market the components on a part-by-part basis, or as a complete system. Thus it is now possible to market a powder or bathroom on a cash-and-carry basis while its installation can be completed in a new room or an existing room with a minimum amount of professional plumbing required.

I claim:

1. A method of assembling a plurality of pre-dimensioned and pre-engineered modular units to form at least a powder room within a room section of a building structure, said room section having a wet wall having pressure water lines directed thereto and having a drain-waste-vent pipe unit positioned substantially vertically therein and connected to the drain-waste-vent system of the building structure, said building structure having an electrical power supply, comprising:

(a) pre-dimensioning a plurality of structural members;

(b) selectively assembling said structural members to form a template-like interface frame having at least two sections, one section defining a toilet position, the other section defining a lavatory position;

(c) selectively assembling a drain-waste-vent pipe system and pressure water system for said interface frame for said powder room;

(d) installing said drain-waste-vent pipe system and pressure water system within said interface frame to form a drain-waste-vent pipe and pressure water interface system for said interface frame and said powder room;

(e) mounting said interface frame against the wet wall of the room section;

(f) connecting said interface drain-waste-vent pipe system to said drain-waste-vent pipe unit positioned within the wet wall;

(g) securing a pre-dimensioned shroud member to said interface frame at the toilet position thereof, said shroud member defining a finished wall portion and having means to receive and accumulate water therein and control means to selectively release flush water through an opening defined by a lower portion of the water accumulating means;

(h) installing against said shroud member, a modular pre-dimensioned toilet bowl having a rear flush water inlet opening and a rear flush water outlet opening while substantially simultaneously connecting said water inlet opening of said modular toilet bowl to the water outlet opening of said shroud member in sealed relation therewith, and the flush water outlet opening of said modular toilet bowl to the drain opening of said drain-waste-vent system in sealed relation therewith;

(i) installing a modular pre-dimensioned cabinet against said interface frame adjacent the lavatory section of said interface frame;

(j) installing a modular wash bowl on said cabinet, said wash bowl having water fixtures connected thereto;

(k) connecting the pressure water system of said wet wall to said water inlet means of said shroud member;

(l) installing a modular pre-dimensioned medicine cabinet on said interface frame at the lavatory position thereof, said cabinet having lighting means attached thereto;

(m) providing electrical power from the power supply of said building to said lighting means; and (n) providing water connections to said water fixtures of said modular wash bowl by connecting water supply conduits from the water pipes of said interface frame to said fixtures and connecting the waste pipe system of said interface frame to said modular wash bowl thereby completing the connections between the building structure and the powder room.

2. A method of assembling a plurality of pre-dimensioned and pre-engineered modular units to form at least a bathroom within a room section of a building structure, said room section having a wet wall having pressure water lines directed thereto and having a drain-waste-vent pipe unit positioned substantially vertically therein and connected to the drain-waste-vent system of the building structure, said building structure having an electrical power supply, comprising:

(a) pre-dimensioning a plurality of structural members;

(b) selectively assembling said structural members to form a template-like interface frame having at least three sections, one section defining a bathtub position, a second section defining a toilet position, the other section defining a lavatory position;

(c) selectively assembling a drain-waste-vent pipe system and pressure water system for said interface frame for said bathroom;

(d) installing said drain-waste-vent pipe system and pressure water system within said interface frame to form a drain-waste-vent pipe and pressure water interface system for said interface frame and said bathroom;

(e) mounting said interface frame against the wet wall of the room section;

(f) connecting said interface drain-waste-vent pipe system to said drain-waste vent pipe unit positioned within the wet wall;

(g) installing a modular pre-dimensioned bathtub within said room section at the bathtub location of said interface frame for said bathroom;

(h) connecting the tub drain to the drain-waste-vent pipe system of said interface frame;

(i) installing a first finished pre-dimensioned shower wall surround over the forward portion of said bathtub;

(j) installing a second finished pre-dimensioned shower wall surround over said bathtub in adjacent relation to said first wall surround and interlocking the adjacent end portions thereof to maintain them securely in position;

(k) installing a third finished pre-dimensioned shower wall surround over the rear portion of said bathtub and connecting the end portion adjacent the second surround with the end portion of said second wall surround;

(l) installing a water supply spout in a manner to extend a portion thereof through said first wall surround and attaching said spout to the interface frame to secure said wall surround in position;

(m) installing an escutcheon having a securing member by extending the securing member through the first wall surround and connecting said member to an attachment member attached to the bathtub section of the interface frame to further secure said first shower wall surround;

(n) installing a shower head having a water supply pipe and bracket means by extending said bracket means through the first shower wall surround and connecting the shower head to a water supply pipe;

(o) installing a shower curtain rod between the first and second wall surrounds to maintain the positions of said wall surrounds so as to form a finished shower enclosure;

(p) securing a pre-dimensioned shroud member to said interface frame at the toilet position thereof, said shroud member defining a finished wall portion and having means to receive and accumulate water therein and control means to selectively release the water through an opening defined by a lower portion of the water accumulating means;

(q) installing against said shroud member, a modular pre-dimensioned toilet bowl having a rear flush water inlet opening and a rear flush water outlet opening while substantially simultaneously connecting said water inlet opening of said modular toilet bowl to the water outlet opening of said shroud member in sealed relation therewith, and the flush water outlet opening of said modular toilet bowl to the drain opening of said drain-waste-vent system in sealed relation therewith;

(r) installing a modular pre-dimensioned cabinet against said interface frame adjacent the lavatory section of said interface frame;

(s) installing a modular wash bowl on said cabinet, said wash bowl having water fixtures connected thereto;

(t) connecting the pressure water system of said wet wall to said water inlet of said shroud member;

(u) installing a modular pre-dimensioned medicine cabinet on said interface frame at the lavatory position thereof, said cabinet having lighting means attached thereto;

(v) providing electrical power from the power supply of said building to said lighting means; and (w) providing water connections to said water fixtures of said modular wash bowl by connecting water supply conduits from the water pipes of said interface frame to said fixtures and connecting the waste pipe system of said interface frame to said modular wash bowl thereby completing the connections between the building structure and the bathroom.

3. The method according to claim 1 further comprising installing an elastomer seal in the rear water inlet opening of said modular toilet bowl and a wax seal in the rear flush water outlet opening of said modular toilet bowl, positioning said modular toilet bowl adjacent the toilet section of the interface frame, aligning the water inlet opening and outlet opening of said modular toilet bowl with the corresponding pipe members of the interface frame, and securing the rear portion of said modular toilet bowl to the toilet section of the interface frame while supporting said modular toilet bowl on the floor of the room.

4. The method according to claim 2 further comprising installing an elastomer seal in the rear water inlet opening of said modular toilet bowl and a wax seal in the rear flush water outlet opening of said modular toilet bowl, positioning said modular toilet bowl adjacent the toilet section of the interface frame, aligning the water inlet opening and outlet opening of said modular toilet bowl with the corresponding pipe members of the interface frame, and securing the rear portion of said modular toilet bowl to the toilet section of the interface frame while supporting said modular toilet bowl on the floor of the room.

* * * * *